US008273182B2

(12) United States Patent
Mixdorf

(10) Patent No.: US 8,273,182 B2
(45) Date of Patent: Sep. 25, 2012

(54) DEVICES AND METHODS FOR CLEANING AND DRYING ICE SKATE BLADES

(75) Inventor: Brian M. Mixdorf, New Ulm, MN (US)

(73) Assignee: WLR Enterprises, LLC, New Ulm, MN (US)

( * ) Notice: Subject to any disclaimer, the term of this patent is extended or adjusted under 35 U.S.C. 154(b) by 403 days.

(21) Appl. No.: 12/503,229

(22) Filed: Jul. 15, 2009

(65) Prior Publication Data

US 2010/0012150 A1 Jan. 21, 2010

Related U.S. Application Data

(60) Provisional application No. 61/080,928, filed on Jul. 15, 2008.

(51) Int. Cl.
*B08B 7/00* (2006.01)
*A47L 23/04* (2006.01)

(52) U.S. Cl. ..... 134/6; 15/236.06

(58) Field of Classification Search ... 134/6; 15/236.01, 15/236.06, 237, 245
See application file for complete search history.

(56) References Cited

U.S. PATENT DOCUMENTS

| | | | | |
|---|---|---|---|---|
| 130,925 | A | 8/1872 | Little | |
| 1,310,137 | A | 7/1919 | Sadowsky | |
| 1,542,279 | A | 6/1925 | Turner et al. | |
| 1,880,340 | A * | 10/1932 | Cole | 280/825 |
| 1,952,476 | A | 3/1934 | Barlow | |
| 1,952,477 | A | 3/1934 | Stich | |
| 2,334,796 | A | 11/1943 | Steinmetz et al. | |
| 2,826,774 | A | 3/1958 | Skrainka | |
| 2,903,727 | A | 9/1959 | Rattay | |
| 2,903,731 | A | 9/1959 | Huhtala | |
| 2,954,572 | A | 10/1960 | Skrainka | |
| 3,583,720 | A | 6/1971 | Fowlkes | |
| 3,637,231 | A | 1/1972 | Weidenbacker | |
| 3,670,459 | A | 6/1972 | Welton | |
| 3,841,030 | A | 10/1974 | Laszlo | |
| 3,968,535 | A | 7/1976 | Nichols, Jr. | |
| 4,021,054 | A | 5/1977 | Csutor | |
| 4,219,975 | A | 9/1980 | Scholler | |
| 4,264,090 | A * | 4/1981 | Davies | 280/825 |
| 4,382,616 | A | 5/1983 | Olivieri | |
| 4,392,674 | A | 7/1983 | Evon | |
| 4,546,999 | A | 10/1985 | Lehr | |
| 4,616,428 | A | 10/1986 | Leger | |
| 4,673,196 | A | 6/1987 | Hall | |
| 5,167,170 | A | 12/1992 | Croteau | |

(Continued)

FOREIGN PATENT DOCUMENTS

GB 2 258 807 A 2/1993

*Primary Examiner* — Michael Kornakov
*Assistant Examiner* — Caitlin N Dunlap
(74) *Attorney, Agent, or Firm* — Patterson Thuente Christenson Pedersen, P.A.

(57) ABSTRACT

A handheld device for removing moisture from a skate blade, the device including a body and multiple wiper blades. The body includes a front end and a rear end and defines a skate blade pathway substantially parallel to an axis extending from the front end to the rear end. The multiple wiper blades are located within the body along an axis extending from the front end to the rear end, and are adapted to contact a surface of a skate blade traversing the skate blade pathway.

11 Claims, 9 Drawing Sheets

U.S. PATENT DOCUMENTS

| | | | |
|---|---|---|---|
| 5,255,929 | A | 10/1993 | Lemelson |
| 5,320,366 | A | 6/1994 | Shing |
| 5,383,307 | A | 1/1995 | Anderson |
| 5,569,064 | A | 10/1996 | Gleadall |
| 5,607,347 | A | 3/1997 | Schoen et al. |
| 5,809,605 | A | 9/1998 | Gringer |
| 5,833,270 | A | 11/1998 | Hubshman |
| 5,860,182 | A | 1/1999 | Sareyani |
| 5,879,229 | A | 3/1999 | Anderson |
| 5,916,018 | A | 6/1999 | Watt |
| 5,941,568 | A | 8/1999 | White, II |
| 6,030,283 | A | 2/2000 | Anderson |
| 6,312,017 | B1 | 11/2001 | Hardwick et al. |
| 6,322,266 | B1 | 11/2001 | Traynor |
| 6,666,479 | B1 | 12/2003 | Maddaleni |
| 6,851,680 | B2 | 2/2005 | Pham et al. |
| 6,866,569 | B2 | 3/2005 | Cozzini |
| 6,983,282 | B2 | 1/2006 | Stern et al. |
| 7,031,961 | B2 | 4/2006 | Pitkow et al. |
| 7,054,886 | B2 | 5/2006 | Stern et al. |
| 7,055,204 | B2 | 6/2006 | Ajluni |
| 7,065,483 | B2 | 6/2006 | Decary et al. |
| 7,197,531 | B2 | 3/2007 | Anderson |
| 7,280,957 | B2 | 10/2007 | Newman et al. |
| 7,357,420 | B2 | 4/2008 | Hyser |
| 7,469,444 | B1 | 12/2008 | Thomas |
| 2001/0034919 | A1* | 11/2001 | Faggiotto ..... 15/236.06 |
| 2004/0237350 | A1 | 12/2004 | Latham et al. |
| 2005/0082773 | A1 | 4/2005 | Julien |
| 2005/0109372 | A1 | 5/2005 | Massaro |
| 2005/0134010 | A1 | 6/2005 | Blankenburg et al. |
| 2005/0198757 | A1 | 9/2005 | Gavney, Jr. et al. |
| 2006/0036966 | A1 | 2/2006 | Yevdayev |
| 2006/0059128 | A1 | 3/2006 | Ruggle et al. |
| 2006/0065076 | A1 | 3/2006 | Friol |
| 2006/0248021 | A1 | 11/2006 | Jain et al. |
| 2006/0248048 | A1 | 11/2006 | Jain et al. |
| 2006/0288087 | A1 | 12/2006 | Sun |
| 2007/0106694 | A1 | 5/2007 | Mori et al. |
| 2007/0130126 | A1 | 6/2007 | Lucovsky et al. |
| 2007/0208613 | A1 | 9/2007 | Backer |
| 2007/0282887 | A1 | 12/2007 | Fischer et al. |
| 2008/0005125 | A1 | 1/2008 | Gaedeke |
| 2008/0289128 | A1 | 11/2008 | Billig et al. |

* cited by examiner

DEVICES AND METHODS FOR CLEANING AND DRYING ICE SKATE BLADES

RELATED APPLICATION

The present application claims priority to U.S. Provisional Application No. 61/080,928, filed Jul. 15, 2008, and entitled "HANDHELD DEVICE FOR CLEANING AND DRYING ICE SKATE BLADES," which is incorporated by reference herein in its entirety.

FIELD OF THE INVENTION

The present invention relates generally to devices and methods for maintaining ice skates. More particularly, the present invention relates to devices and methods for cleaning and drying ice skate blades.

BACKGROUND OF THE INVENTION

During use, ice skate blades tend to accumulate ice, slush, water, and various forms of moisture, that need to be removed after use. Conventionally, a skater or user will use a cloth, rag, or some sort of fabric material, to clean, dry, and otherwise remove moisture and debris from the blades of the ice skate. However, using a cloth to remove moisture not only exposes the person cleaning and drying the skate blade to a number of potential safety hazards, but remains a less-than-optimal method of maintaining a pair of skates.

For example, rags used to remove moisture from skate blades may be stored in equipment bags between uses, with insufficient drying time between use and storage. When a user stores a moist rag in an equipment bag prior to proper drying, the rag may become moldy over time, potentially exposing the skater and others to airborne mold spores. Further, using a rag or other cloth to dry a skate blade creates the potential for the person cleaning and drying the skates to accidentally be cut or wounded by a relatively sharp skate blade.

In addition to safety and maintenance concerns, using cloths to clean and dry skate blades causes environmental waste. Due to frequent use, cloths used to dry blades become dirty very quickly, and require frequent washing and disposal.

In addition to wiping ice skate blades with a cloth, other methods for removing solid moisture or debris include moving a stiff-bristle brush over an ice skate blade. U.S. Pat. No. 2,826,774 to Skrainka ("Skrainka") discloses a combined blade-guard and cleaner for ice skates. The "cleaner" of Skrainka takes the form of a brush attached to a blade guard. The brush is designed for use while a skate remains on the foot of a user.

However, such conventional methods do not result in a thoroughly dry skate blade, potentially leading to rusting, and pitting of the skate blade. This significantly decreases the life of the blade, and can cause the need to prematurely purchase new skates. Not only will a poorly maintained skate blade deteriorate more quickly, but a poorly maintained blade can quickly dull and may cause injuries to the person using the skates. Therefore, ice skate blades must be completely dried and cleaned after each use.

SUMMARY OF THE INVENTION

In one embodiment, the present invention is a handheld device for removing moisture from a skate blade, the device comprising a body and a plurality of wiper blades. The body includes a front end and a rear end, and defines a skate blade pathway substantially parallel to an axis extending from the front end to the rear end. The plurality of wiper blades are disposed within the body along an axis extending from the front end to the rear end, and adapted to contact a surface of a skate blade traversing the skate blade pathway.

In another embodiment, the present invention is a device for removing moisture from a skate blade that includes a generally rigid body adapted to be held in the hand of a user. The body defines a first skate blade receiving slot located at a first end of the body, a second skate blade receiving slot located at a second end of the body, and a first cavity for collecting moisture removed from the skate blade. The device also includes a plurality of flexible wiper blades operably coupled to the body such that each wiper blade projects along an axis generally perpendicular to an axis extending from the first end of the body to the second end of the body.

The present invention also includes a method of cleaning and drying skate blades that includes grasping a handheld device adapted to remove moisture from a skate blade with a hand of a user, the handheld device including a body defining a skate blade pathway and a plurality of wiper blades; aligning the pathway of the body with the skate blade such that the skate blade and the pathway are substantially aligned along a common axis; causing at least one of the plurality of wiper blades to contact a first end of the skate blade at a side surface of the skate blade; and moving the device in a direction along the common axis from the first end of the skate blade to a second end of the skate blade, such that the plurality of wiper blades wipe the side surface of the skate blade, thereby removing moisture from the side surface of the skate blade.

The above summary of the various embodiments of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
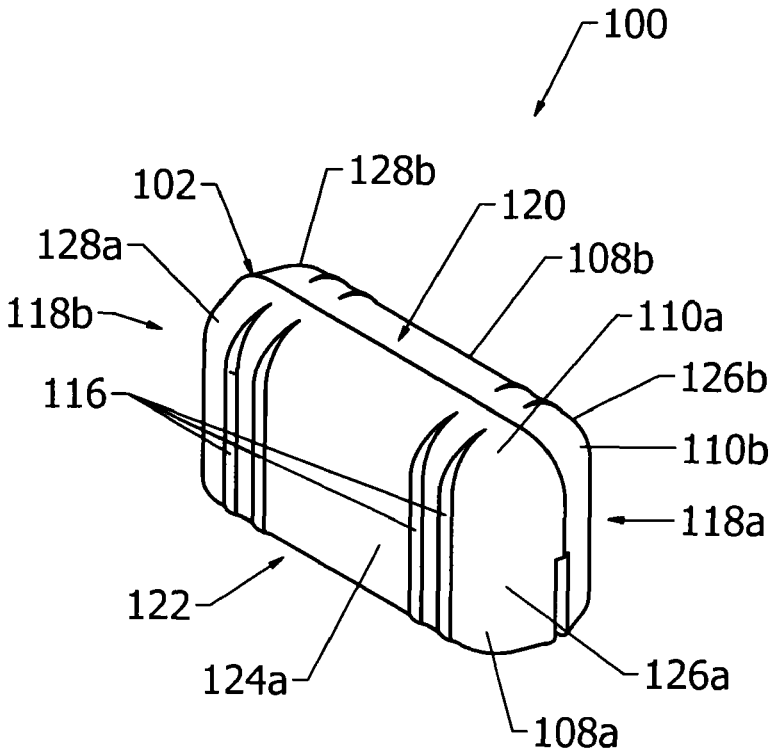
FIG. 1 is a top perspective view of a skate maintenance device according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

FIGS. 1-9 depict skate maintenance device 100 according to an embodiment of the invention. Device 100 includes body 102, plugs 104, and wiper blades 106.

Referring to FIGS. 1-6, body 102 is generally rectangular in shape and in one embodiment includes first body portion 108*a* coupled to second body portion 108*b*. In other embodiments, body 102 may comprise a single body portion, or more than two body portions. Body 102 is sized and adapted to be held in a user's hand. In one embodiment, body 102 length $L_B$ ranges from 2.5 inches to 4 inches, body 102 height $H_B$ ranges from 1.3 inches to 2 inches, body 102 width $W_B$ ranges from 0.8 inches to 1.4 inches. In the embodiment depicted, $L_B$ is approximately 3.20, $H_B$ is approximately 1.58 inches, and $W_B$ is approximately 1.15 inches. Dimensions $L_B$, $W_B$, and $H_B$ of body 102 may be scaled up or down depending on whether the specific embodiment is intended to be grasped by an adult user or a child user. Further, dimensions $L_B$, $W_B$, and $H_B$ may change to accommodate various skate and skate blade sizes and designs.

It will be understood that in other embodiments, the shape of body 102 may be generally square, circular, or oval, rather than generally rectangular, while maintaining the characteristic of being readily graspable by a user.

Body portions 108*a* and 108*b* may be made of a generally rigid material such as plastic, including acetyl plastic, metal, ceramic, or other suitable material. Body portions 108*a* and 108*b* include exterior surfaces 110*a* and 110*b*, interior surfaces 112*a* and 112*b*, generally flat bottom surfaces 114*a* and 114*b*, and multiple ribs 116. Body portions 108*a* and 108*b* when coupled together form front end 118*a*, rear end 118*b*, top portion 120, and bottom portion 122. It will be understood that the terms front, rear, top, and bottom are used for the purposes of describing the figures, but are not meant to suggest or limit aspects of the claimed invention.

Exterior surface 110*a* curves downward from top portion 120 towards bottom portion 122 to form generally flat sidewall 124*a*, curved front wall 126*a*, and curved rear wall 128*a*; exterior surface 110*b* curves downward from top portion 120 towards bottom portion 122 to form generally flat sidewall 124*b* (not shown), curved front wall 126*b*, and curved rear wall 128*b*.

Figure 3:
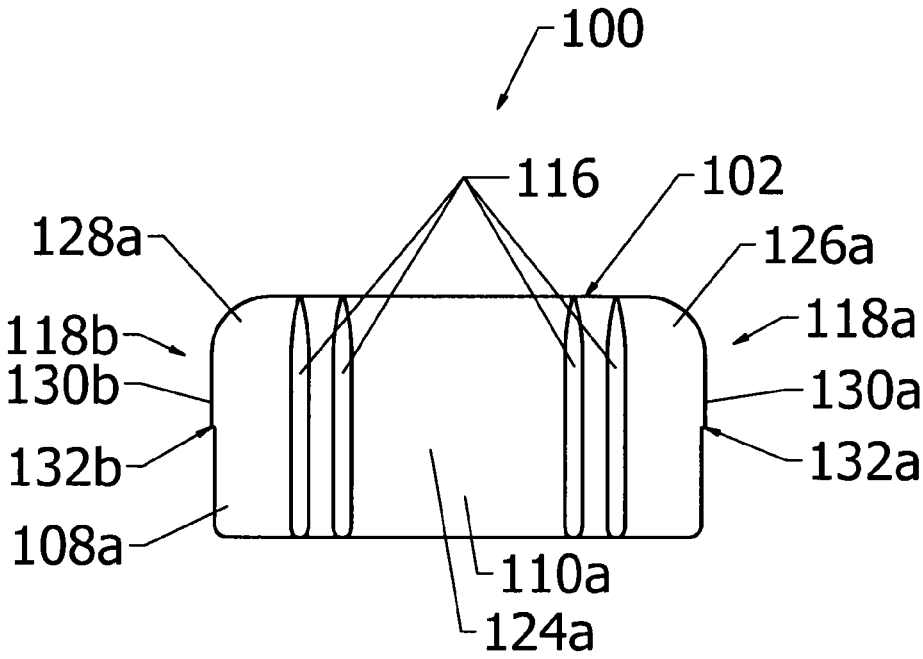
FIG. 3 is a left side elevational view of the skate maintenance device of FIG. 1.
Figure 4:
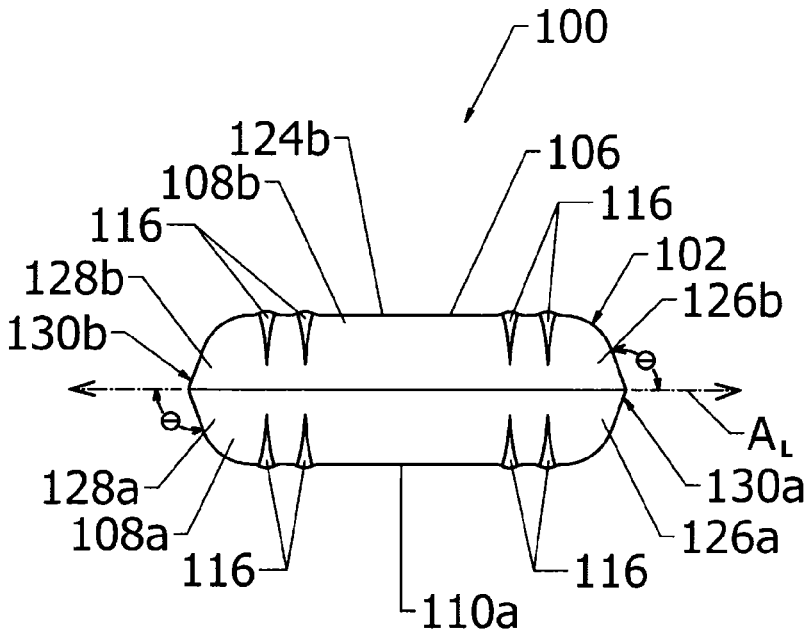
FIG. 4 is a top elevational view of the skate maintenance device of FIG. 1.

Referring specifically to FIGS. 3 and 4, front end 118*a* includes curved front walls 126*a* and 126*b* which together taper into front projection 130*a*. Similarly, rear end 118*b* includes curved rear walls 128*a* and 128*b*, which together taper into rear projection 130*b*. Projections 130*a* and 130*b* extend downward from top portion 120 toward bottom portion 122, terminating at corners 132*a* and 132*b*, respectively.

Front walls 126*a* and 126*b*, and rear walls 128*a* and 128*b*, each form an angle θ with respect to a longitudinal axis $A_L$. Angle θ may generally be equal to, or greater than, 90 degrees. In one embodiment, angle θ ranges from 90 to 135 degrees. In the embodiment depicted, angle θ is approximately 110 degrees.

In other embodiments, front walls 126*a* and *b* and rear walls 128*a* and *b* do not taper and therefore do not form projections 130.

Ribs 116 project outwardly and away from exterior surfaces 110*a* and 110*b*, extending upwardly from bottom portion 122, along sidewalls 124*a* and 124*b*, and tapering to an end at top portion 120. In one embodiment, each body portion 108*a* and 108*b* includes two pairs of ribs 116, one pair located generally towards front end 118*a* and one pair located generally towards rear end 118*b*. Each pair of ribs 116 includes two individual ribs substantially parallel to each other, with spacing between the two ribs approximately equal to the width of one individual rib. It will be understood that in other embodiments, each body portion 108*a* and 108*b* may include more or fewer ribs 116, and that the location and spacing of ribs 116 may be vary. Ribs 116 help a user maintain a sure grip of device 100, especially when the exterior of device 100 is wet or moist.

Alternatively, body portions 108*a* and 108*b* may not include ribs 116 and/or may include surface texturing or other means to aid a user in gripping device 100.

Figure 5:
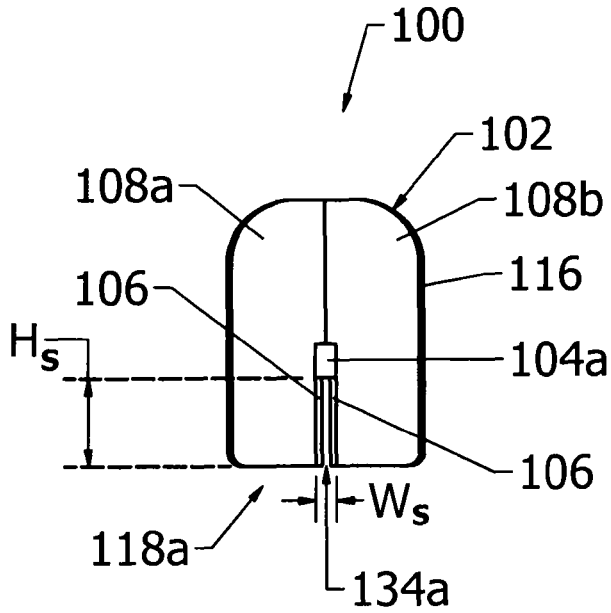
FIG. 5 is a front elevational view of the skate maintenance device of FIG. 1.
Figure 6:
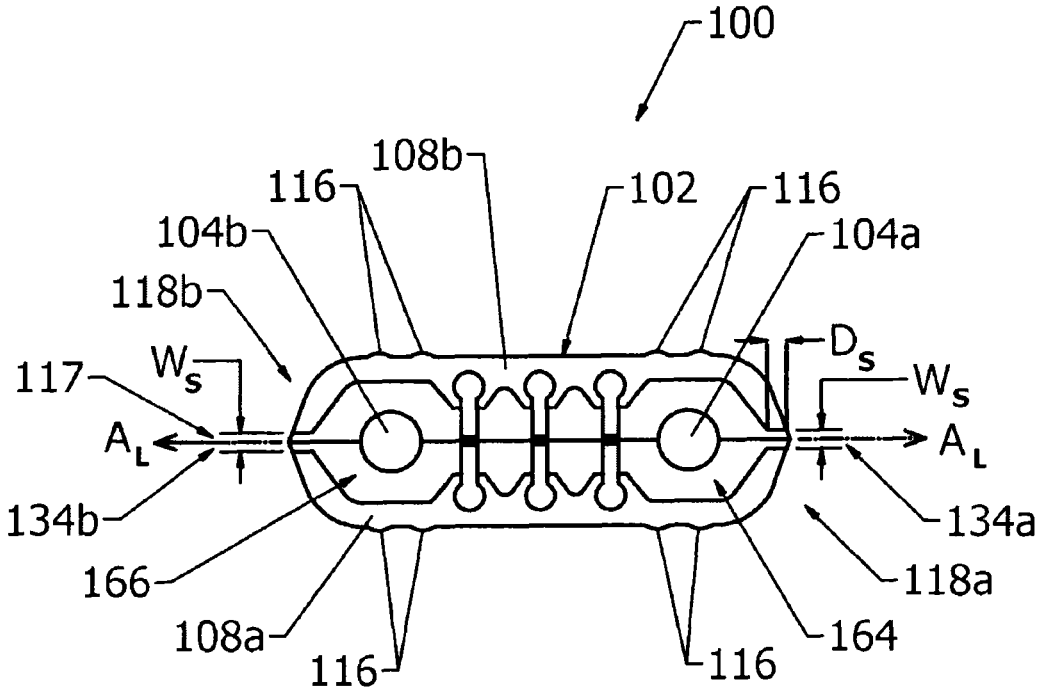
FIG. 6 is a bottom elevational view of the skate maintenance device of FIG. 1.

Referring to FIGS. 5 and 6, body 102 defines skate blade pathway 117. Pathway 117 extends along axis $A_L$ from front end 118*a* to rear end 118*b* through body 102. In the depicted embodiment, pathway 117 includes skate blade receiving slots 134*a* and 134*b*. Front end 118*a* and rear end 118*b* each define skate blade receiving slot 134*a* and 134*b*, respectively. Skate blade receiving slots 134*a* and 134*b* are generally sized to receive a portion of ice skate blade 136 of skate 137 (depicted in FIG. 12), with slots 134*a* and 134*b* height $H_S$ generally being equal to or less than height $H_{SB}$ of skate blade 136, and slot 134 width $W_S$ generally being slightly greater than thickness $T_{SB}$ (depicted in FIG. 14). If width $W_S$ is too much larger than skate thickness $T_{SB}$, it may be difficult for a user to guide the front portion of skate blade 136 through wiper blades 106 and into second slot, slot 134*b*. Therefore, $W_S$ may be varied to accommodate various skate blade thicknesses.

Depth $D_S$ of each slot 134 varies according to a desired material thickness of body portions 108*a* and 108*b* at front and rear ends 118*a* and 118*b*. A longer depth $D_S$ also helps a user guide skate blade 136 through the interior of device 100 and into an opposite slot 134.

In one embodiment, $H_S$ ranges from 0.6 inches to 0.8 inches and $W_S$ ranges from 0.10 inches to 0.15 inches. In the embodiment depicted, $H_S$ is approximately 0.72 inches and $W_S$ is approximately 0.13 inches. In one embodiment, $D_S$ is approximately 0.15 inches. Such an embodiment may be particularly suited to hockey skates, or thin-bladed figure skates, that typically have a blade thickness of approximately 0.125 inches. In other embodiments, particularly those directed to typical figure skates having thicker blades of perhaps 0.14 inches or 0.15 inches, Ws may be increased to accommodate the thicker blade.

Figure 7:
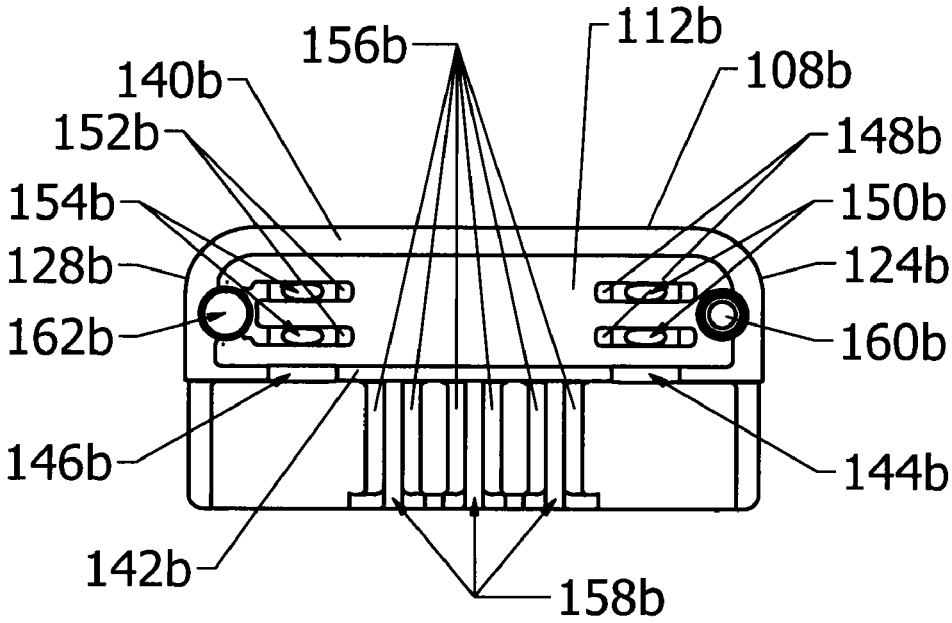
FIG. 7 is top elevational view of a body portion of the skate maintenance device of FIG. 1.
Figure 8:
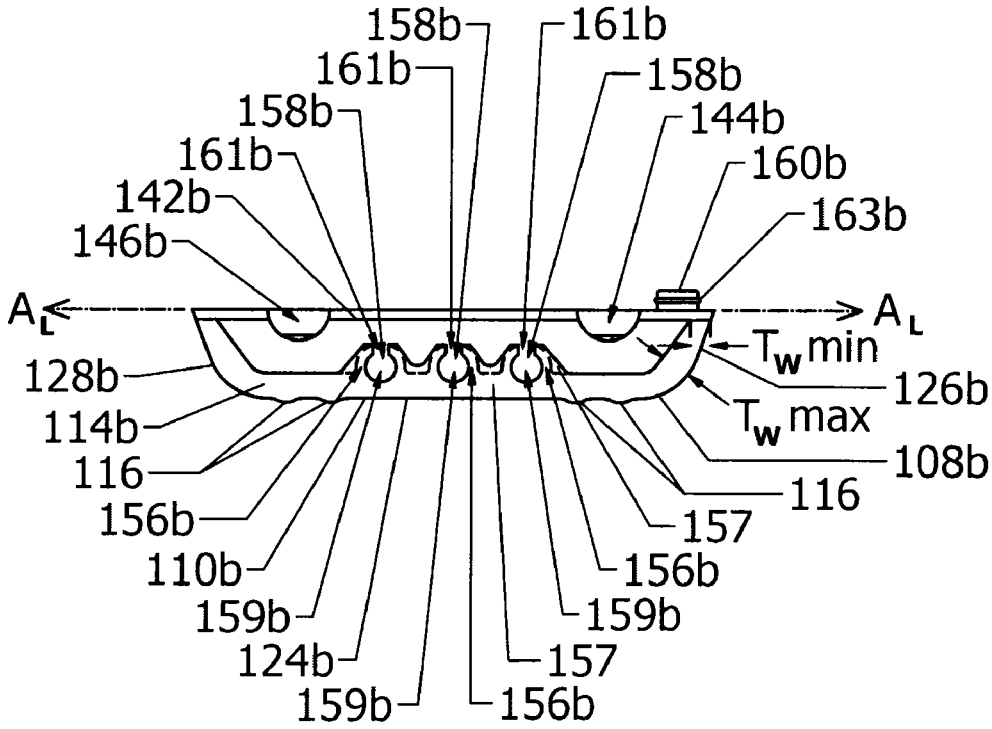
FIG. 8 is a bottom elevational view of the body portion of FIG. 7.
Figure 9:
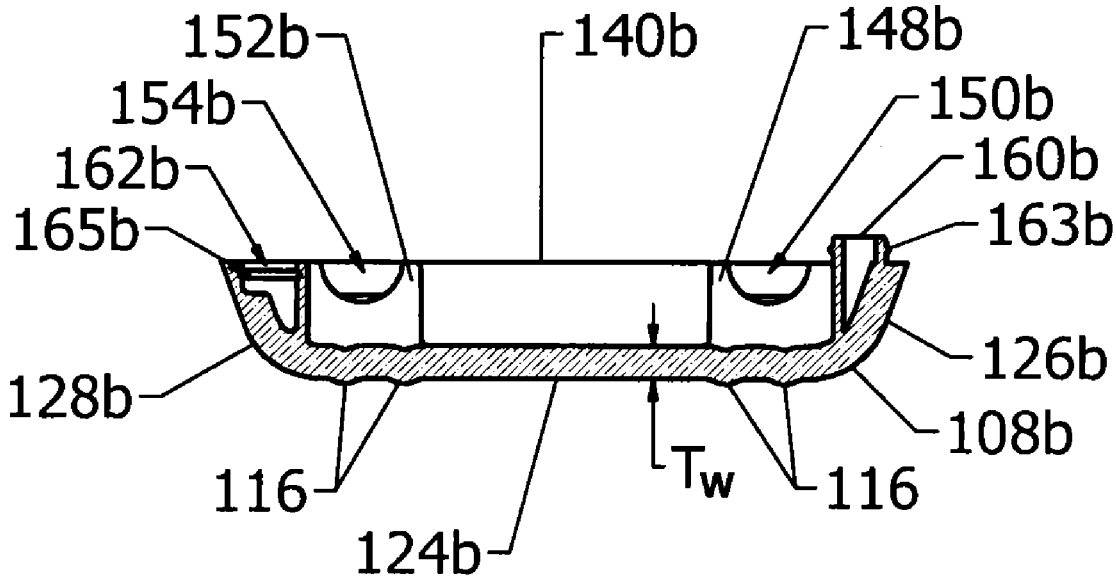
FIG. 9 is a top elevational view of the body portion of FIG. 7.

Referring to FIGS. 7-9, body portion 108*b* is depicted. It will be understood that body portion 108*a* is substantially the same as body portion 108*b*, with the exception of differences described below.

Body portion 108*b* as previously described includes exterior surface 110*b* forming sidewall 124*b*, front wall 126*b*, and rear wall 128*b*, as well as interior surface 112*b*, generally flat bottom surface 114*b*, and multiple ribs 116. In the depicted embodiment, body portion 108*b* also includes top wall 140*b* and support wall 142*b*, both projecting generally perpendicular to interior surface 112*b* and generally traversing the length of body portion 108*b*.

Support wall 142*b* includes a pair of semi-circular recesses defining front support-wall plug-receiving recess 144*b* and rear support-wall plug-receiving recess 146*b*. Recesses 144*b* and 146*b* receive a portion of plugs 104 (refer also to FIGS. 2 and 6), aiding in supporting and securing plugs 104 in assembled device 100. Although depicted and described as semi-circular, recesses 144*b* and 146*b* may define other shapes, such as square, rectangular, or otherwise, so as to receive and accommodate the shape of plugs 104.

Plugs 104 are further supported and secured by a plurality of front plug supports 148*b* defining a plurality of plug receiving recesses 150*b*, a plurality of rear plug supports 152*b* defining a plurality of plug receiving recesses 154*b*. Plug supports 148*b* and 152*b* generally project upward and away from surface 112*b*, with individual plug supports being equally spaced apart from each other, and from top wall 140*b* and support wall 142*b*. The height of plug supports 148*b* and 152*b* may be generally equal to a height of top wall 140*b* and support wall 142*b*, or somewhat less, such that recesses 148*b* generally align with support wall recess 144*b* and recesses 152*b* generally align with support wall recess 146*b* along axes perpendicular to support wall 142*b*.

In another embodiment, not depicted, plug supports 148*b* and 152*b* each comprise a single support block spanning from support wall 142*b* to 140*b*, each including a contiguous recess or channel, to receive support plugs 104.

Body portion 108*b* also includes a plurality of wiper blade supports 156*b* defining wiper blade receiving channels 158*b*. In the embodiment depicted, body portion 108*b* includes three wiper blade supports 156*b* for supporting three wiper blades 106 (refer also to FIGS. 2 and 6). However, in other embodiments, body portion 108*b* may include more, or fewer, wiper blade supports 156*b*, depending on the desired number of wiper blades 106 to be included in device 100.

Wiper blade supports 156*b* generally extend lengthwise from support wall 142*b* to surface 114*b*. Portions of wiper blade supports 156*b* generally extend upwardly and away from inner surface 112*b*. In the embodiment depicted, wiper blade supports 156*b* receive wiper blades 106 such that a lower approximately half of each wiper blade along its height is supported, while an upper half of each wiper blade is unsupported and able to bend with the force of skate blade 136. Increasing the height of wiper blade supports 156 in relation to a wiper blade 106 generally increases the degree of support of each wiper blade, while decreasing the unsupported portion of each wiper blade 106 protruding from each wiper blade support 156*b*. This increased height and subsequent decreased exposed portion of blades 106 generally results in a decreased movement of each wiper blade 106 when contacting skate blade 136, and an increased amount of force exerted from wiper blade 106 to skate blade 136. The interaction between wiper blades 106 and skate blade 136 is discussed further with respect to FIGS. 13 and 14 below.

In the embodiment depicted in FIG. 8, wiper blade supports 156*b* form a generally circular cross-sectional shape. In other embodiments, wiper blade supports 156*b* may generally form square, rectangular, trapezoidal, or other cross-sectional shapes. As depicted, body 108*b* may also include additional support structure 157 at each end of wiper blade support 156.

Wiper blade receiving channels 158*b* are shaped to receive and support wiper blades 106. In the embodiment depicted, wiper blade receiving channels 158*b* include a generally cylindrical portion 159*b* and a generally rectangular portion 161*b*, though the specific shape of wiper blade receiving channels 158*b* will vary to match the shape of wiper blades 106.

Each body portion 108*b* also includes post 160*b*. Post 160*b* is located near front wall 126*b*, and between top wall 140*b* and support wall 142. Post 160*b* projects generally away from, and perpendicular to, inner surface 112*b*. In the embodiment depicted, post 160*b* includes optional detent 163*b*.

Body portion 108*b* also defines post receiving opening 162*b* including detent receiving openings 165*b*. Post receiving opening 162*b* is located generally adjacent rearwall 128*b*, between top wall 140*b* and support wall 142*b*. Post receiving opening is generally sized to receive a post 160*a*, discussed below, while detent receiving opening 165*b* is generally sized to receive detents 163*a*, as also discussed further in detail below.

Body portion 108*a* includes post 160*a* and post receiving opening 162*a* (not depicted). Post 160*a* is substantially the same as post 160*b*, but is located adjacent rear wall 128*a*, rather than front wall 124*a*. Likewise, post receiving opening 162*a* is substantially the same as post-receiving opening 162*b*, but is located adjacent front wall 124*a*, rather than rear wall 128*a*.

When body portion 108*a* is joined in assembly to body portion 108*b*, post 160*a* is received by post receiving opening 162*b*, and post 160*b* is received by post receiving opening 162*a*. Detent receiving openings 165*b* receive detents 163*a*, while detent receiving openings 165*a* receive detents 163*b*, thereby securing posts 160 into openings 162, and securing body portion 108*a* to body portion 108*b*.

In other embodiments, body portions 108*a* and 108*b* may not include posts 160*a* and 160*b*, and openings 162*a* and 162*b*. In such embodiments, body portions 108*a* and 108*b* may be held together using alternate means. These alternate means may include other known structure and methods for snap-fitting the portions together, or may include gluing, welding and so on.

In yet other embodiments, body portions 108*a* and 108*b* may be releasably fitted together. In such embodiments, fasteners extending from one body portion to another may be used. Thus allowing a user to disassemble device 100 for maintenance or repair.

Sidewall 124*b*, front wall 126*b*, rear wall 128*b*, and top wall 140 may generally comprise a uniform wall thickness $T_W$ which may vary according to material and desired strength. In one embodiment comprising acetyl plastic, wall thickness $T_W$ is approximately 0.18 inches.

Referring to FIG. 8, in the depicted embodiment, wall thickness $T_W$ is generally uniform, having an average thickness of $T_{Wavg}$, with the exception of front wall 126*b* and rear wall 128*b*. In this embodiment, both front wall 126*b* and rear wall 128*b* comprise a non-uniform thickness $T_W$. Thickness $T_W$ of front wall 126*b* and rear wall 128*b* is maximized at a thickness of $T_{Wmax}$ at a region near where each wall meets sidewall 124*b*, and minimized at $T_{Wmin}$ at a region furthest from sidewall 124. Maximum thickness $T_{Wmax}$ is generally greater than $T_{Wavg}$, and minimum thickness $T_{Wmin}$ is generally less than $T_{Wavg}$. In the depicted embodiment, thickness $T_W$ decreases uniformly by approximately 50%, or from $T_{Wmax}$ approximately equal to 0.25 inches down to $T_{Wmin}$ approximately equal to 0.125 inches.

The changing thickness TW of front wall 126*b* and rear wall 128*b* provides additional strength along longitudinal axis $A_L$.

Support wall 142*b* longitudinally traverses body portion 108*b* from front wall 126*b* to rear wall 128*b*, providing support to assembled body 102. In the embodiment depicted, support wall 142*b* traverses approximately the center of body portion 108*b*, though slightly offset towards bottom surface 114*b*. The latitudinal, or top-bottom, location of support wall 142*b* defines skate blade receiving slot 134*b* height $H_S$, and a maximum length of wiper blade support channels 158*b*. Support wall thickness may vary according to material and desired support strength, and in one embodiment comprises acetyl plastic that is 0.08 inches thick.

Figure 2:
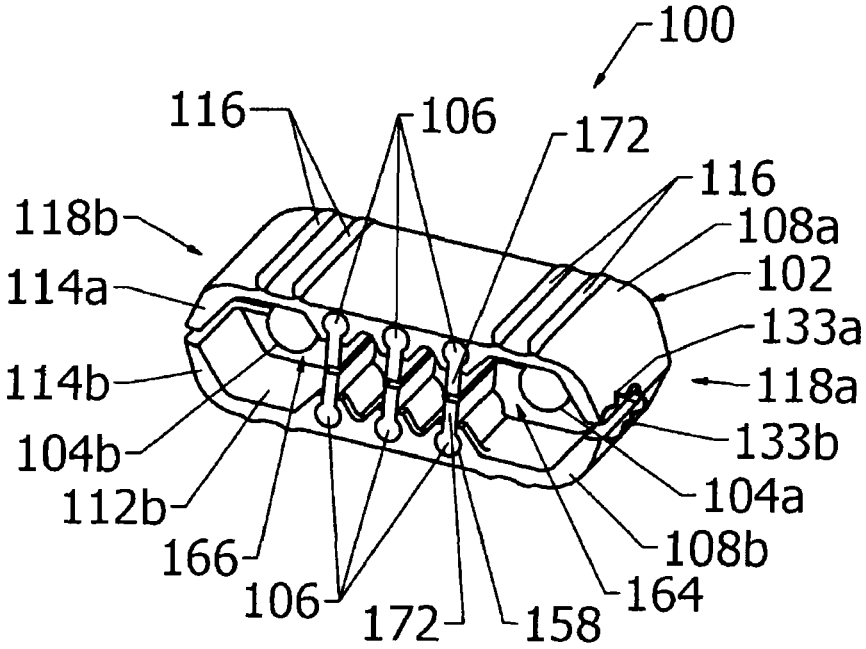
FIG. 2 is a bottom perspective view of the skate maintenance device of FIG. 1.

Referring to FIGS. 2 and 6, body portions 108*a* and 108*b*, when joined together form front cavity portion 164, and rear cavity portion 166.

Figure 10A:
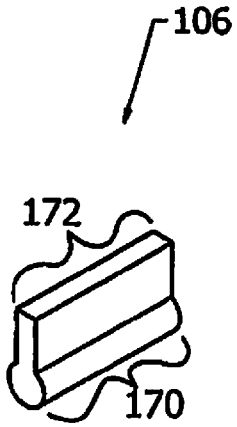
FIG. 10*a* is a perspective view of a wiper blade according to an embodiment of the invention.
Figure 10B:
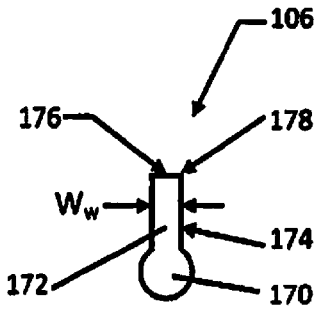
FIG. 10*b* is a front elevational view of the wiper blade of FIG. 10*a;*
Figure 10C:
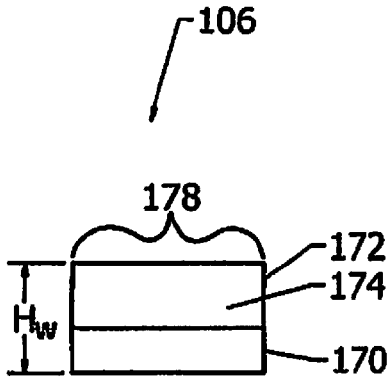
FIG. 10*c* is a side elevational view of a wiper blade of FIG. 10*a;*

Referring to FIGS. 10*a-c*, in the embodiment depicted, wiper blades 106 include a generally cylindrical base portion 170 and a generally rectangular top portion 172. Top portion 172 includes a front surface 174 and a top surface 176, extending the length of wiper blade 106. Top surface 176 and front surface 174 are generally planar and meet at right angles to form front edge 178. In another embodiment, top surface 176 may be curvilinear, rather than planar, and may further meet front surface 174 to form an angle greater than 90 degrees.

Base portion 170 and top portion 172 are sized to fit into wiper receiving channels 158 of body portions 108 such that a portion of top portion 172 protrudes from channels 158. The size and shape of wiper blades 106 may vary according to size variations in body portions 108. For example, in another embodiment, base portion 170 may be generally rectangular in shape, rather than cylindrical; in yet another embodiment, base portion 170 may be an extension of top portion 172 such that base portion 170 and 172 are virtually indistinguishable from one another.

$H_w$ defines a height of wiper blade 106, while $W_w$ defines a width of wiper blade 106. Wiper blade height Hw may vary not only according to overall body 102 size, but also according to skate blade receiving slot Ws and skate thickness Tsb. Embodiments adapted for use with narrower blade hockey skates may employ wiper blades 106 having a larger height Hw so as to create a narrower gap between opposing wiper blades 106 of opposing pairs. Embodiments adapted for use with wider blade skates, such as figure skates, may employ wiper blades 106 having smaller heights Hw so as to create a larger gap between opposing wiper blades 106 of opposing pairs.

Wiper blades 106 may be formed from a material such as rubber, or other similar flexible, resilient material. In one embodiment, wiper blades 106 are formed of a rubber compound having a Shore Scale A durometer hardness of 60. Generally, wiper blades 106 may be formed of a compound having a hardness ranging from 40 to 80. In other embodiments, different compounds outside the hardness range of 40 to 80 may also be employed.

Figure 11A:
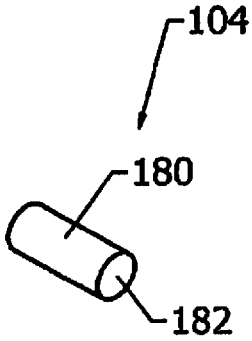
FIG. 11*a* is a perspective view of a plug according to an embodiment of the present invention.
Figure 11B:
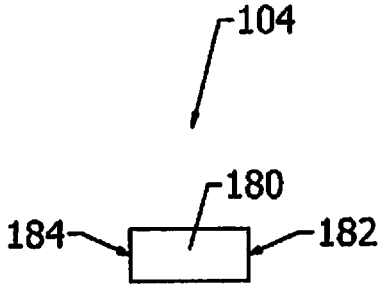
FIG. 11*b* is a side elevational view of the plug of FIG. 11*a;*
Figure 11C:
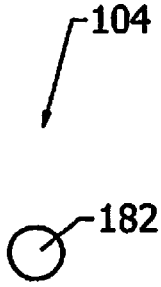
FIG. 11*c* is a front elevational view of the plug of FIG. 11*a;*

Referring to FIGS. 11*a-c*, plugs 104 may be generally cylindrical in shape and include an outer surface 180, wiping surface 182, and bottom surface 184. Although depicted as generally cylindrical, plugs 104 may alternatively form non-cylindrical shapes. In other embodiments, plugs 104 at their ends may form square, triangular, rectangular, or diamond shapes. Plugs 104 are shaped and sized so as to be received and secured by body portions 108.

In one embodiment, plugs 104 may comprise an absorbent material such as felt, though in other embodiments, alternative materials having varying absorbent properties may be used.

Referring again to FIG. 2, when assembled, body portion 108*a* is joined to body portion 108*b*, with posts 160 inserted into post receiving openings 162, to form body 108. The plurality of wiper blades 106 are inserted into their respective wiper blade receiving channels 158 such that a portion of top portions 172 extend outward from channels 158. Plugs 104 are received and secured by body portions 108, with a portion of each plug 104 extending into cavities 164 and 166.

The plurality of wiper blades 106 may comprise any number of wiper blades. In the embodiments depicted, device 100 includes six wiper blades 106 arranged as three pairs of wiper blades, each pair comprised of two wiper blades located opposite each other (across pathway 117). In other embodiments, fewer than six wiper blades may be used. Wiper blades 106 may also be distributed in a staggered arrangement such that individual wiper blades 106 are not located directly opposite one another.

Figure 12A:
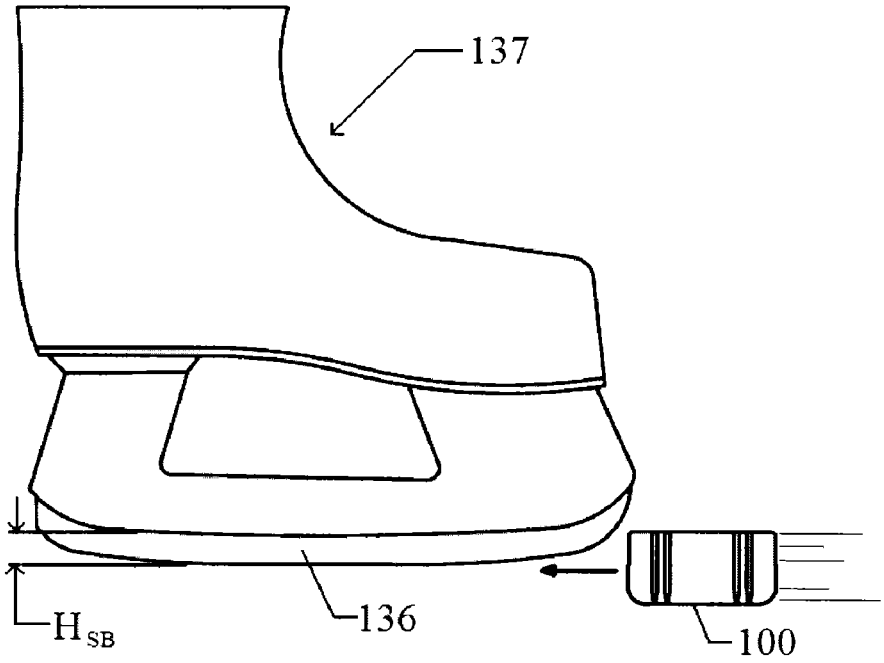
FIG. 12*a* is a side elevation view of the skate maintenance device of FIG. 1 positioned near the front of a skate.
Figure 12B:
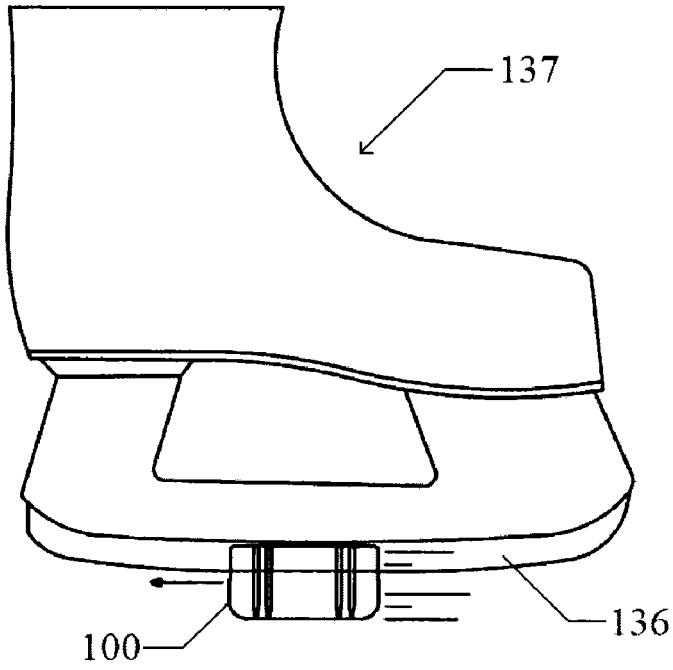
FIG. 12*b* is a side elevation view of the skate maintenance device of FIG. 1 as positioned on the blade of a skate.
Figure 13:
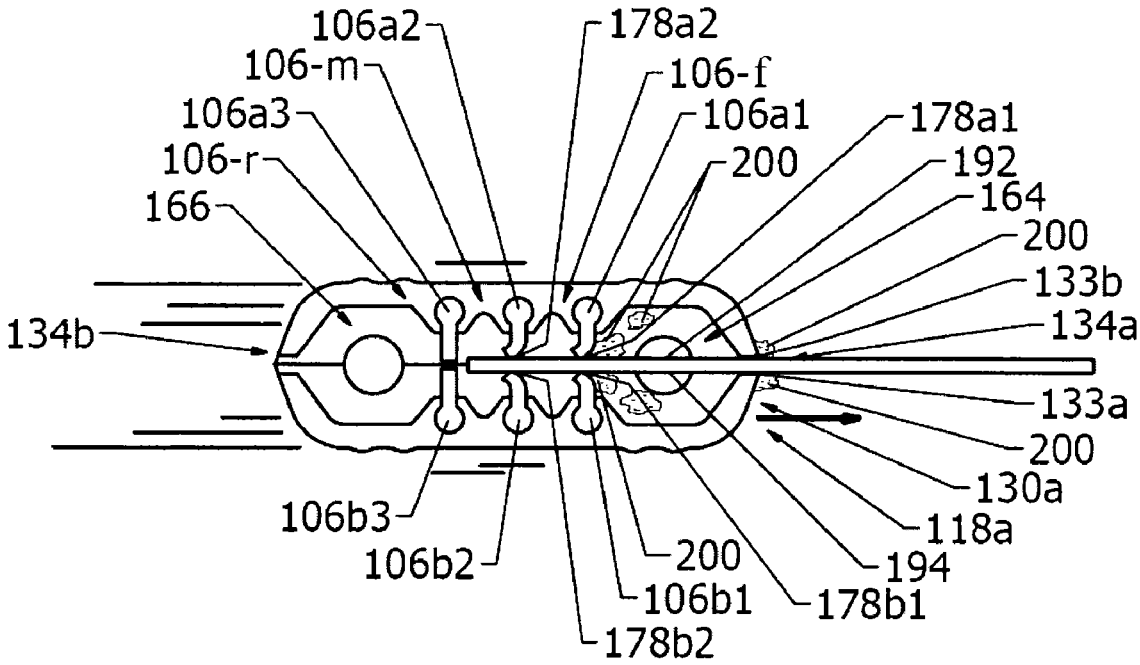
FIG. 13 is a cross-sectional view of a skate blade partially inserted into the skate maintenance device of FIG. 1.

Referring to FIGS. 12 and 13, in general use, device 100, held in the hand of a user (not depicted), is positioned at a front end of skate blade 136 of skate 137. Although skate 137 is depicted as a standard hockey skate, skate 137 also includes goalie skates, figure skates, and other known types of skates for skating on ice. Front end of skate blade 136 is inserted into device 100, which is then moved along the length of skate blade 136 toward the rear of skate blade 136. As device 100 is moved along skate blade 136, ice, moisture, and other debris which has collected on skate blade 136 is removed by device 100. Depending on the shape of skate blade 136, device 100 may alternatively be firstly positioned at a rear of skate blade 136 and moved from the rear towards the front of skate blade 136.

Ice, moisture, and debris are removed through at least three different interactions between device 100 and skate blade 136. These three interactions, described further below, include contact between front end 118*a* and moisture collected on multiple surfaces of skate blade 136, contact between wiping surfaces 182 of plugs 104 and a bottom surface of skate blade 136, and contact between wiper blades 106 and left and right surfaces of skate blade 136.

Figure 14:
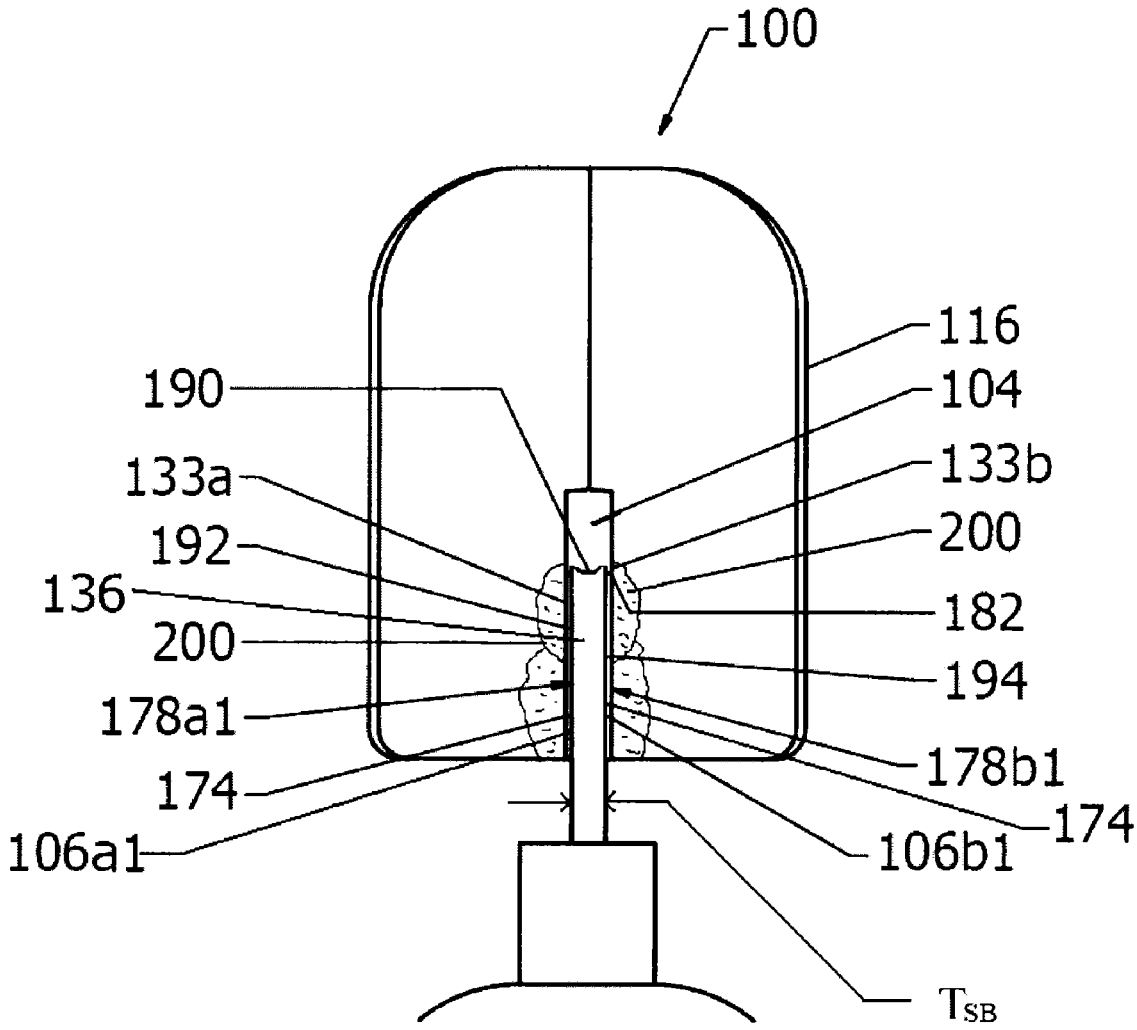
FIG. 14 is an end elevation view of a skate blade inserted into the skate maintenance device of FIG. 1.

Referring to FIGS. 13 and 14, device 100 is depicted as having received a portion of skate blade 136. A front end of skate blade 136 has passed through skate blade receiving slot 134*a* and is in contact with front and middle pairs of opposing wiper blades 106. Curved bottom surface 190 of skate blade 136 is in contact with a first plug 104.

Referring specifically to FIG. 13, as device 100 is moved along skate blade 136, larger pieces of moisture 200, including ice, slush, and/or water, are removed from skate blade 136 by front end 118*a* and projection 130*a* of device 100. More specifically, when blade 136 is passed through front slot 134*a*, a portion of moisture 200 clinging to left and right sides of skate blade 136 contacts front slot edges 133*a* and 133*b*. As device 100 moves relative to skate blade 136, this portion of moisture 200 is removed from left skate surface 192 and right skate surface 194 by front end 118*a*, including projection 130*a* and edges 133. The greater-than-ninety-degrees angle θ formed between front walls 126 and skate blade 136 surfaces 192 and 194 helps remove larger-sized moisture 200 more easily and efficiently. Removed moisture 200 accumulates on the exterior surfaces of curved front walls 126, or falls via gravity away from device 100.

Still referring to FIG. 13, moisture 200 that is not initially removed by front end 118*a* from skate blade 136 left and right surfaces 192 and 194 may be removed through contact with the plurality of wiper blades 106.

As skate blade 136 is passed between wiper blades 106, each wiper blade 106 flexes, leaving a portion of wiper blade 106 in contact with a left surface 192 or right surface 194 of skate blade 136. For convenience, three opposing wiper blade pairs have been labeled in FIG. 13: front pair 106-*f*, consisting of wiper blades 106*a*1 and 106*b*1, middle pair 106-*m*, consisting of wiper blades 106*a*2 and 106*b*2, and rear pair 106-*r*, consisting of wiper blades 106*a*3 and 106*b*3. As depicted, pairs 106-*f* and 106-*m* are in contact with skate blade 136.

When skate blade 136 is forced between wiper blade pairs 106-*f* and 106-*m*, wiper blades 106 bend in a direction of movement of skate blade 136, or from front to rear as depicted in FIG. 13. The flexure of each wiper blade 106 causes edge 178 of wiper blade 106 to contact skate blade 136. More specifically, and as depicted, edges 178*a*1 and 178*a*2 contact left surface 192 of skate blade 136, while edges 178*b*2 and 178*b*2 contact right surface 194 of skate blade 194. As skate blade 136 is moved through device 100, wiper blade pair 106-*r* and its edges 178 will likewise contact skate blade 136 left and right surfaces 192 and 194.

Depending on the hardness and wear of wiper blades 106, a portion of each front surface 174 and top surfaces 176, nearest edges 178, may also be in contact with skate blade 136.

The flexing of wiper blades 106 causes edges 178 and adjacent surfaces to exert a force onto portions of surfaces 192 and 194 of skate blade 136 at the points of contact. Moving skate blade 136 through wiper blade pairs 106-*f,m,r* thus causes a wiping or squeegee action which removes moisture 200 remaining on surfaces 192 and 194 of skate blade 136. Blade pair 106-*f* tends to remove more moisture 200 than wiper blade pair 106-*m*, which in turn tends to remove more moisture than wiper blade pair 106-*r*. Dependent upon specific orientation of device 100, moisture 200 removed by wiper blades 106 may fall or drip downward into cavities 164 and 166, and collect in the space between wiper blade pairs 106.

Referring to FIG. 14, in a third method of removing moisture 200, a slight force is applied to device 100 in a direction toward skate 137. Curved bottom surface 190 of skate blade 136 is in contact with wiping surface 182 of plug 104. Because plug 104 comprises a conformable material, which in the depicted embodiment comprises felt, plug 104 and wiping surface 182 conform to the curvilinear shape of curved bottom surface 190 such that there is substantially no air gap between curved bottom surface 190 and wiping surface 182.

Moisture 200 collected on curved bottom surface 190 is absorbed in part, or in whole, by plug 104. Further, moisture 200 or other debris typically present on bottom surface 190 may be removed by plug 104 in a scraping action as device 100 is dragged along skate 137 (or as skate 137 is dragged along device 100). Excess moisture 200 not absorbed by plug 104 may stay on wiping surface 182 until it is absorbed by plug 104, or may alternatively be pushed or otherwise fall into cavities 164 and 166.

After moving device 100 along the entire length of skate blade 136, device 100 may be removed, and moisture 200 and other debris removed from skate blade 136 and contained within device 100 may be tipped, shaken, or otherwise removed from device 100.

Although the present invention has been described with respect to the various embodiments, it will be understood that numerous insubstantial changes in configuration, arrangement or appearance of the elements of the present invention can be made without departing from the intended scope of the present invention. Accordingly, it is intended that the scope of the present invention be determined by the claims as set forth.

What is claimed is:

1. A handheld device for removing moisture from a skate blade, comprising:

a body, including a front end and a rear end, the body defining a skate blade pathway substantially parallel to a longitudinal axis extending from the front end to the rear end, and defining a front skate blade receiving slot and a rear skate blade receiving slot; and a plurality of flexible wiper blades disposed within the body and distributed along the longitudinal axis extending from the front end to the rear end, each of the plurality of flexible wiper blades having a height greater than a width, the height being transverse to the longitudinal axis;

a plug disposed within the body and adapted to contact a bottom surface of the skate blade;

wherein each of the plurality of flexible wiper blades flexes forward or backward along the longitudinal axis and contacts a surface of a skate blade when the skate blade is traversing the skate blade pathway.

2. The device of claim 1, wherein the plurality of wiper blades comprises a plurality of opposing pairs of wiper blades.

3. The device of claim 2, wherein the plurality of opposing pairs of wiper blades comprises three pairs of wiper blades.

4. The device of claim 1, wherein the wiper blades comprise a rubber material having a hardness durometer of 60.

5. The device of claim 1, further comprising a second plug disposed within the body and adapted to contact the bottom surface of the skate blade, wherein the first plug is located adjacent the front end, and the second plug is located adjacent the rear end.

6. The device of claim 1, wherein the plug comprises an absorbent material adapted to absorb moisture collected on a bottom surface of the skate blade.

7. The device of claim 6, wherein the plug comprises felt.

8. The device of claim 1, wherein one or both of the front end and rear end comprises a projection adapted to remove moisture from a bottom surface of the skate blade.

9. The device of claim 1, wherein the body is generally rectangular in shape.

10. The device of claim 1, wherein the body comprises a plastic material.

11. The device of claim 1, wherein the front skate blade receiving slot has a height substantially equal to a height of the rear skate blade receiving slot.

* * * * *